United States Patent [19]

Brunosson et al.

[11] 4,304,158

[45] Dec. 8, 1981

[54] GRIP SLEEVE FOR A HANDLE

[75] Inventors: Bengt B. Brunosson, Enköping; Lars Erlandsson, Eskilstuna, both of Sweden

[73] Assignee: Aktiebolaget Bahco Verktyg, Sweden

[21] Appl. No.: 126,646

[22] Filed: Mar. 3, 1980

[51] Int. Cl.[3] ..... B25B 7/02

[52] U.S. Cl. ..... 81/428 R; 81/417

[58] Field of Search ..... 81/428 R, 417; 30/261, 30/262, 191

[56] References Cited

U.S. PATENT DOCUMENTS

| | | | |
|---|---|---|---|
| 444,035 | 1/1891 | Wyatt | 81/428 R |
| 776,828 | 12/1904 | Earnhart | 30/262 |
| 3,082,652 | 3/1963 | Marti | 81/428 R |
| 3,680,212 | 8/1972 | Rozmus | 30/191 |
| 4,074,597 | 2/1978 | Jansson | 30/261 |

*Primary Examiner*—James L. Jones, Jr.

*Attorney, Agent, or Firm*—Klarquist, Sparkman, Campbell, Leigh, Whinston & Dellett

[57] ABSTRACT

A grip sleeve (1) from plastics or the like material, for a handle of a pliers or nippers of the kind which has at least one leaf spring (3) between both its handles for opening the pliers. To localize and retain the spring, the sleeve is formed with an elongate slot (4) on its side facing towards the opposite handle, the slot being open towards the opposite handle and is T-shaped, seen in cross section through the sleeve. At one end, the slot has its cross section, which is suited to the cross-sectional dimensions of the spring, freely exposed for inserting the spring in the crossbar (5) of the T. The stem (6) of the T forms the opening of the slot and the spring is thereby kept in place by flanges (7) on either side of this opening, formed by the T configuration.

6 Claims, 3 Drawing Figures

GRIP SLEEVE FOR A HANDLE

The invention relates to a grip sleeve made from plastics or similar material, for a leg or handle of a pliers or nippers of the kind having at least one leaf spring, disposed for opening the pliers, between both its handles.

Such pliers are already known, which have one end of a leaf spring inserted between the sleeve of one of the handles and the handle for retaining the spring. It is similarly known to fix the ends of such a spring to either handle by inserting the respective spring end between handle and sleeve. Compared with pliers having their springs permanently fixed to the material of the handle, e.g. by riveting, the inserted springs afford the advantage that they are exchangeable if the spring should break or its elasticity fade. Their attachment is however somewhat uncertain and positionally indeterminate, as well as being subjected to variation by the sleeve becoming worn at the point of insertion. The inserting operation is also rather expensive when the spring is originally fitted, e.g. when producing the pliers, since there is a limited space between the handles which makes the point of insertion difficult to get at.

The object of the invention is to provide a grip sleeve which, while maintaining spring exchangeability offers good control and positive location of the spring in all directions, and which facilitates the initial fitting of the spring.

The desired result is obtained by the grip sleeve being given the characterizing features disclosed in patent claim 1.

An embodiment of the invention will now be described in detail while referring to the appended drawing.

Figure 1:
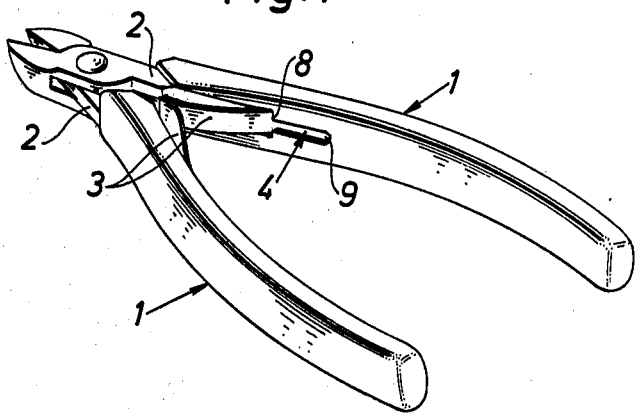
FIG. 1 is a perspective view of a pliers or nippers with both legs made with grip sleeves in accordance with the invention.

The pliers or nippers illustrated in FIG. 1 is a side cutter, each of the handles 2 of which has a grip sleeve 1. It may be assumed that the pliers is made from steel and the sleeves from plastics. A leaf spring 3 is arranged on each handle 2. The back ends of the springs are carried in the sleeves 1, and their front free ends, facing towards the joint portion of the pliers, mutually abut when the handles are moved towards each other for cutting off, for opening the pliers to a starting position for the next cut when hand force is removed from the handle sleeves.

Figure 2:
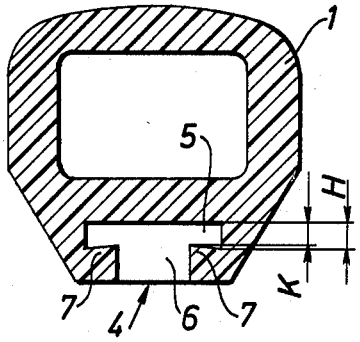
FIG. 2 is a cross section of a sleeve of the kind illustrated in FIG. 1. The section is taken in the region of a fixing slot for the handle spring, and the figure illustrates the sleeve without a spring in this slot.
Figure 3:
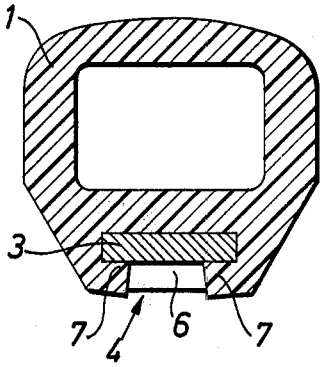
FIG. 3 is a cross section corresponding to the one in FIG. 2 but with the spring inserted in the slot.

Each sleeve 1 is formed with a longitudinal slot 4 on its side facing towards the opposite handle. This slot is open towards the opposite handle. From the cross sections of the sleeve in FIGS. 2 and 3 it will be seen that the slot 4 is a T-slot. The crossbar 5 of the T-slot is dimensioned to suit the cross section of the leaf spring, and its stem 6 forms the opening of the slot towards the handle opposite. One end 8 of the slot 4 has the slot cross section freely exposed, to enable insertion of the spring 3 in the crossbar 5. The spring is kept in place by the flanges 7, formed as a result of the T-shape, on either side of the stem 6.

In the illustrated embodiment, the slot 4 and spring 3 may be assumed to have a constant cross section along coacting portions of their length. It is however also possible to give the spring 3 a cross section tapering towards the end inserted into the sleeve 1, the crossbar 5 of the slot being given a correspondingly decreasing cross section for coaction with the spring.

It will be seen from FIG. 1 that the portion of the slot 4 formed by the stem 6 in the cross section, i.e. the opening towards the opposite handle, extends in the longitudinal direction of the sleeve past the portion of the slot formed by the crossbar 5 of the cross section. This is at the end 9 of the slot which is remote from the insertion end 8 for the spring 3. The portion of the slot formed by the stem 6 thus affords seating for a tool, such as a thin punch, behind the end of the spring to remove it from the slot.

With the flanges 7 free, i.e. without a spring 3 in the slot 4, the sleeve 1 has in cross section varying thickness of the arms of the crossbar 5, this thickness having a dimension H at the extremities of the crossbar corresponding to the maximum dimension of the thickness of the spring at a corresponding place, when the spring is correctly located, for spring and slot with decreasing cross section there is a decreasing dimension H corresponding to the maximum dimension of the spring thickness at the respective place. At the free ends of the flanges 7, the thickness of the crossbar arms has a dimension K which is less than the thickness of the spring at a corresponding place, for spring and slot with decreasing cross section there is a decreasing dimension K which is less than the thickness of the spring at the respective place. The flanges 7 will thus be elastically deformed, as is apparent from FIGS. 2 and 3, to keep the inserted spring 3 in place.

We claim:

1. In combination with a pair of pliers or nippers having a pair of handles and at least one leaf spring disposed between the pair of handles, the spring being positioned adjacent the interior of one of the pair of handles, the spring being arranged to exert a force on the other one of the pair of handles when the pliers are closed, the spring being further arranged to bias the pliers to an open position when a closing force is removed from the handles, the improvement comprising:

a grip sleeve mounted on at least said one of the pair of handles, the sleeve having a longitudinally extending side slot positioned in facing relationship to the other of the pair of handles, the slot having a T-shape when seen in cross-section through the sleeve, the leg of the T-shape extending toward the other of the pair of handles and forming the opening in the slot, the crossbar of the T-shape having its cross-sectional dimensions suited to the cross-sectional dimensions of the leaf spring, one end of the slot being freely exposed to permit insertion of the leaf spring in the crossbar, the leg and the crossbar of the T-shape forming a pair of flanges in the sleeve on opposed sides of the opening in the slot, one end of the leaf spring being received in said one end of the slot, said one end of the leaf spring being retained in position by the pair of flanges.

2. The combination of claim 1 in which the sleeve is a plastic sleeve.

3. The combination of claim 1, in which the leaf spring and the slot have constant cross-sections along coacting portions of their lengths.

4. The combination of claim 1, in which the leaf spring has a decreasing cross-section towards said one end thereof and the slot has a decreasing cross-section towards its said one end for coaction with said one end of the spring.

5. The combination of claim 1, in which the leg of the T-shape extends past the portion of the slot formed by the crossbar towards the other end of the slot remote from its said one end, whereby the leg of the T-shape affords seating for a tool behind said one end of the leaf spring for removing the latter from the slot.

6. The combination of claim 1, in which when the one end of the leaf spring is not inserted in the one end of the slot, the crossbar of the T-shape has a depth at its extremities corresponding to the maximum dimension of the thickness of the leaf spring at a corresponding place, the crossbar having a depth inwardly of its extremities at the free ends of the flanges less than the thickness of the leaf spring at said corresponding place, whereby the flanges are elastically deformed and grip the leaf spring when said one end of the leaf spring is inserted in said one end of the slot.

* * * * *

UNITED STATES PATENT AND TRADEMARK OFFICE

CERTIFICATE OF CORRECTION

PATENT NO. : 4,304,158

DATED : December 8, 1981

INVENTOR(S) : BENGT BRUNO BRUNOSSON and LARS ERLANDSSON

It is certified that error appears in the above-identified patent and that said Letters Patent are hereby corrected as shown below:

Insert in the facing page:

[30] Foreign Application Priority Data

March 19, 1979 Sweden.....7902454

Signed and Sealed this

*Twenty-fifth* Day of *May 1982*

[SEAL]

*Attest:*

GERALD J. MOSSINGHOFF

*Attesting Officer*

*Commissioner of Patents and Trademarks*